US007218052B2

(12) United States Patent
Wijenberg et al.

(10) Patent No.: US 7,218,052 B2
(45) Date of Patent: May 15, 2007

(54) MERCURY FREE METAL HALIDE LAMP

(75) Inventors: Christoffel Wijenberg, Eindhoven (NL); Josephus Christiaan Maria Hendricx, Eindhoven (NL); Matthias Born, Geldern (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 260 days.

(21) Appl. No.: 10/526,200

(22) PCT Filed: Aug. 18, 2003

(86) PCT No.: PCT/IB03/03807

§ 371 (c)(1),
(2), (4) Date: Mar. 1, 2005

(87) PCT Pub. No.: WO2004/023517

PCT Pub. Date: Mar. 18, 2004

(65) Prior Publication Data

US 2005/0248278 A1 Nov. 10, 2005

(30) Foreign Application Priority Data

Sep. 6, 2002 (EP) ..... 02078674

(51) Int. Cl.
*H01J 17/16* (2006.01)

(52) U.S. Cl. ..... 313/634; 313/620

(58) Field of Classification Search ..... 313/493, 313/620, 634

See application file for complete search history.

(56) References Cited

U.S. PATENT DOCUMENTS 4,161,672 A * 7/1979 Cap et al. ..... 313/620
5,144,201 A * 9/1992 Graham et al. ..... 313/634

* cited by examiner

*Primary Examiner*—Vip Patel

(57) ABSTRACT

A Hg-free metal halide lamp comprising a substantially cylindrical discharge vessel with a ceramic wall having an internal diameter Di, an internal length Li and a wall thickness Wt, and filled with an ionizable filling, wherein two electrodes are present having a mutual distance EA for maintaining a discharge in the discharge vessel, wherein the filling comprises an inert gas and a salt, wherein the internal length Li is smaller than 8 mm, wherein the electrode distance EA and the internal diameter Di comply with the relation EA/Di>;2, wherein the inert gas pressure PXe at room temperature is at least 5 bar, and wherein the wall thickness Wt and the internal diameter Di comply with the relation Wt/Di>0.15.

10 Claims, 2 Drawing Sheets

MERCURY FREE METAL HALIDE LAMP

Figure 1:
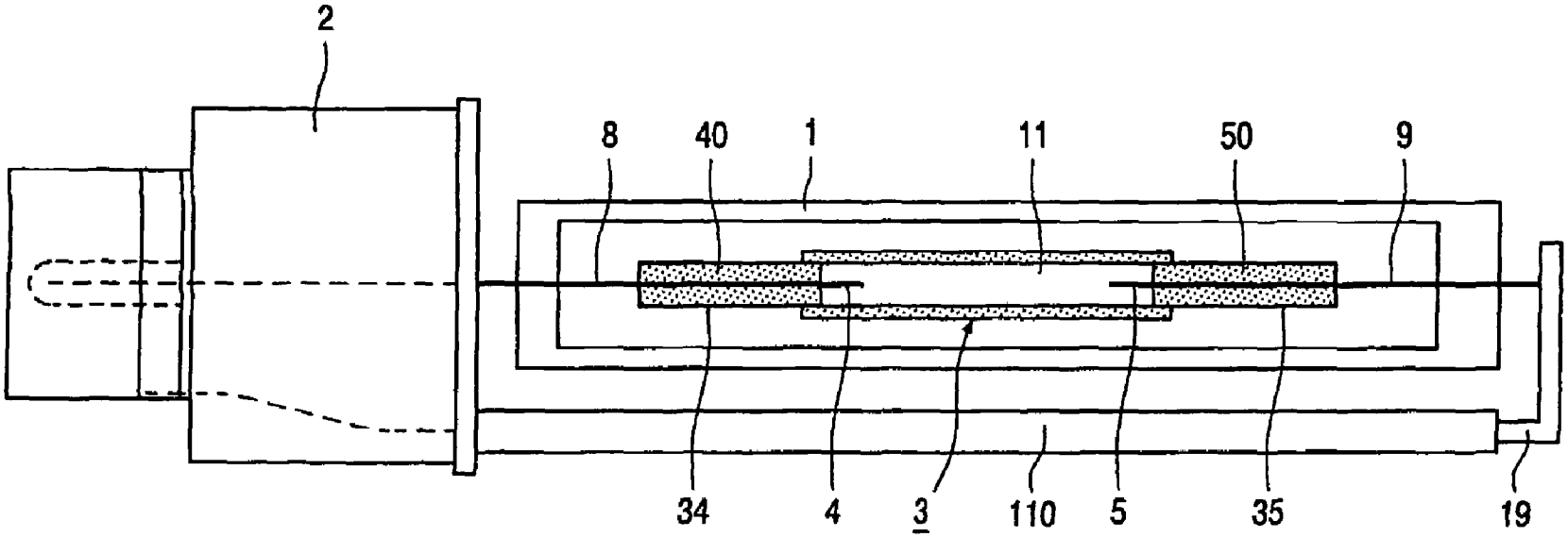

The invention relates to a Hg-free metal halide lamp comprising a substantially cylindrical discharge vessel with a ceramic wall having an internal diameter Di, an internal length Li and a wall thickness Wt, and filled with an ionizable filling, wherein two electrodes are present having a mutual distance EA for maintaining a discharge in the discharge vessel, wherein the filling comprises an inert gas, preferably Xe, and a metal halide.

Many automotive head lighting discharge lamp fillings to date contain mercury (Hg). Since mercury is known to be environmentally very unfriendly, many attempts were made to develop a mercury free metal halide lamp, but no satisfactory results have been obtained. Mercury in these lamps was mainly used to increase the electric field strength, whereby as a consequence the lamp current can be maintained at a low level, and the electronic ballast can therefore be simple and low cost. A suitable and satisfactory replacement for mercury had not yet been found. For general lighting purposes a solution is known where mercury is replaced by Zn or ZnI, but this solution is not suitable for the small automotive lamps, wherein the electrode distance EA is approximately 3–5 mm, and which usually have a power of between 20 and 35 W.

The invention aims at a suitable, efficient and reliable mercury free metal halide lamp for automotive headlight purposes.

After extensive development and testing, a combination of measurements has been found giving satisfactory results. According to the invention the internal length Li of the discharge vessel is smaller than 8 mm, the electrode distance EA and the internal diameter Di must comply with the relation EA/Di>2, the inert gas pressure PXe at room temperature should be at least 5 bar, and the wall thickness Wt and the internal diameter Di must comply with the relation Wt/Di>0.15. It was found that the function of mercury in the lamp can at least partially be taken over by the high pressure of the inert gas, preferably xenon and an extremely small vessel diameter. The discharge vessel must be as short as possible to obtain a sufficiently high coldest spot temperature. Hereby a sufficiently high lamp voltage of approximately 40–90 V can be obtained. The wall of the vessel must be sufficiently thick in order to prevent overheating of the wall and in order to prevent large temperature gradients inside the wall, which both can cause cracking, creep or even melting of the vessel.

Preferably the length of the cylindrical outer surface of the discharge vessel Lo is at least 8 mm, preferably at least 9 mm, more preferably at least 9.5 mm. Hereby a sufficient heat dissipation of the vessel is achieved.

For luminous efficacy the metal halide preferably comprises at least 40 :mol/cm3 of a rare earth iodide, such as NaPrI. Also preferably the metal halide comprises between 20 :molcm3 and 140 :mol/cm3 ZnI2.

Preferably Li<7.5 mm, more preferably Li<6.8 mm, most preferably Li<6.2 mm. Preferably EA/Di>3, more preferably EA/Di>4. In practice EA/Di will usually be smaller than 8, more usually smaller than 6. Preferably Wt/Di>0.20, more preferably Wt/Di>0.25, most preferably Wt/Di>0.3. Preferably PXe>10 bar, more preferably PXe>15 bar. In practice Pxe will usually not be more than 25 bar.

In a prefered embodiment the discharge vessel is surrounded by a transparent substantially cylindrical gas filled outer bulb having its wall at a distance which is less than 1 mm, preferably less than 0.5 mm, for further improving the heat dissipation of, and heat distribution and homogenisation inside the wall of the discharge vessel. Also in a prefered embodiment the discharge vessel is provided with coated areas for increasing the coldest spot temperature.

The above and further aspects of the lamp according to the invention will now be explained by way of an exemplary embodiment and with reference to the drawings (not true to scale), in which:

FIG. 1 diagrammatically shows a lamp according to the invention; and

Figure 2:
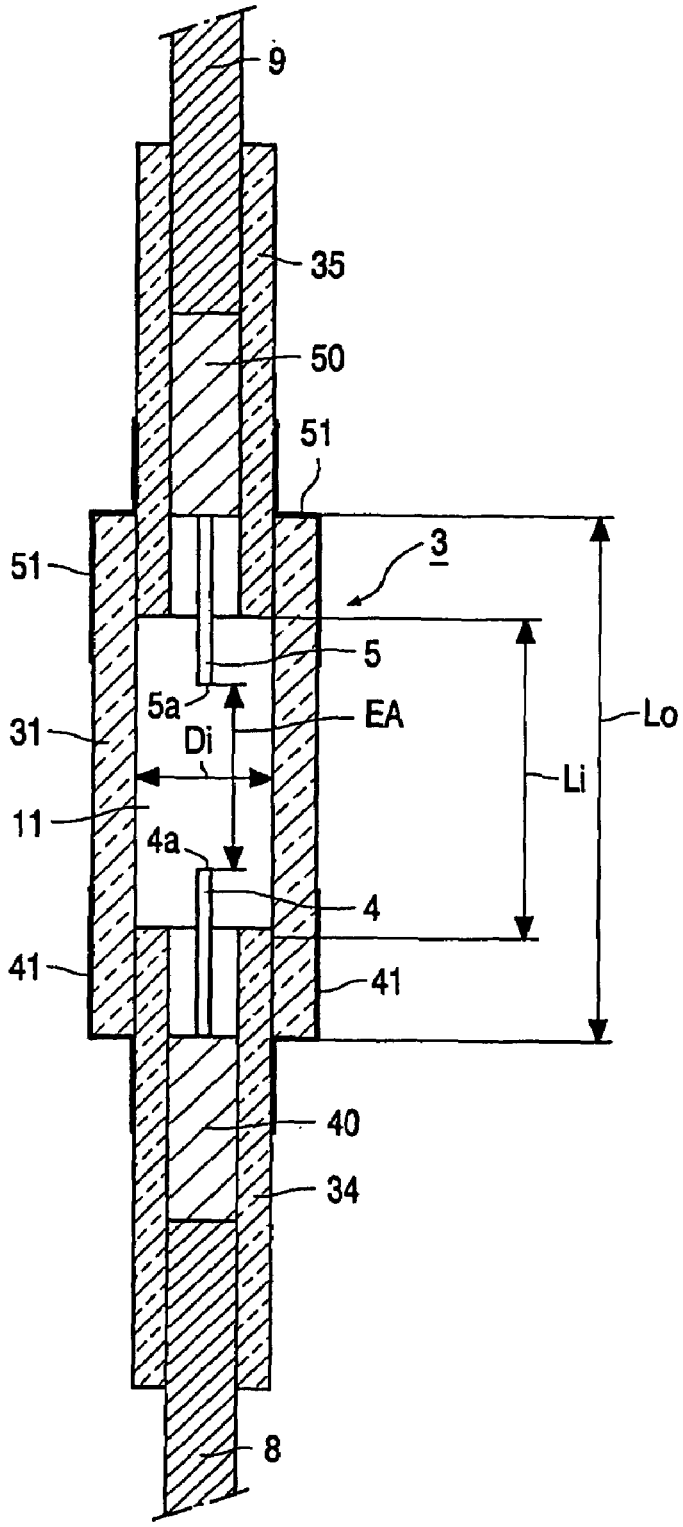

FIG. 2 shows the discharge vessel of the lamp of FIG. 1 in detail.

FIG. 1 shows a metal halide lamp provided with a discharge vessel 3. The discharge vessel 3 is shown in more detail in FIG. 2, with a ceramic wall 31 which encloses a discharge space 11 containing Xe and an ionizable filling. Two electrodes with tips 4*a*, 5*a* having an interspacing EA are arranged in the discharge vessel 3, which has an internal diameter Di at least at the area of the interspacing EA.

The discharge vessel is closed off at either end by a respective ceramic projecting plug 34, 35 which encloses with narrow interspacing a respective current lead-through conductor 40, 50 to the electrode 4, 5 arranged in the discharge vessel. The discharge vessel is surrounded by an outer bulb 1. Part of the ceramic projecting plug 34, 35 and an adjoining portion of the ceramic discharge vessel 3 are provided with an external coating 41, 51. The lamp is further provided with a lamp cap 2. A discharge extends between the electrodes 4 and 5 in the operational state of the lamp. The electrode 4 is connected to a first electrical contact forming part of the lamp cap 2 via a current conductor 8. The electrode 5 is connected to a second electrical contact forming part of the lamp cap 2 via current conductors 9 and 19. The current conductor 19 is surrounded by a ceramic tube 110.

The ionizable filling of the discharge vessel 3 of the lamp comprises 0.6 mg NaPrI and 0.1–0.2 mg ZnI2. The filling further comprises Xe with a filling pressure at room temperature of 16 bar.

The distance between the electrode tips EA is 5 mm, the internal diameter Di is 1.2 mm, so that the ratio EA/Di=4.17. The wall thickness Wt of the discharge vessel 3 is 0.4 mm. The internal length of the discharge vessel 3 Li is 6.0 mm, the outer length Lo is 10 mm. The total length of the discharge vessel 3 and the plugs 34, 35 is 24.0 mm. The diameter of the current lead-through conductors 40, 50 is 0.54 mm.

Part of the ceramic projecting plug 34, 35 and an adjoining portion of the ceramic discharge vessel 3 are provided with an external coating of Pt. The external coating extends to 0.25 mm from the relevant electrode tip. The outer bulb 1 of the lamp is made of quartz glass. The internal diameter of the outer bulb 1 is 3 mm, its wall thickness is 2 mm. The outer bulb 1 is filled with N2 with a filling pressure of 1.5 bar at room temperature.

The lamp has a power of 30 W, and a luminance of 78 Mcd/m2. The maximum wall temperature is approximately 1700 K. The temperature gradient from the upper middle to the lower middle in a horizontally burning discharge vessel is less than 150 K.

The invention claimed is:

1. A Hg-free metal halide lamp comprising a substantially cylindrical discharge vessel with a ceramic wall having an internal diameter Di, an internal length Li and a wall thickness Wt, and filled with an ionizable filling, wherein two electrodes are present having a mutual distance EA for maintaining a discharge in the discharge vessel, wherein the filling comprises an inert gas and a metal halide, wherein the internal length Li is smaller than 8 mm, wherein the electrode distance EA and the internal diameter Di comply with the relation EA/Di>2, wherein the inert gas pressure PXe at room temperature is at least 5 bar, and wherein the wall thickness Wt and the internal diameter Di comply with the relation Wt/Di>0.15.

2. A lamp according to claim 1, wherein the length of the cylindrical outer surface of the discharge vessel Lo is at least 8 mm, preferably at least 9 mm.

3. A lamp according to claim 1, wherein the metal halide comprises at least 40: mol/cm3 of a rare earth iodide.

4. A lamp according to claim 1, wherein the metal halide comprises between 20: mol/cm3 and 140: mol/cm3 ZnI2.

5. A lamp according to claim 1, wherein Li<7.5 mm, preferably Li<6.8 mm, more preferably Li<6.2 mm.

6. A lamp according to claim 1, wherein EA/Di>3, preferably EA/Di>4.

7. A lamp according to claim 1, wherein PXe>10 bar, preferably PXe>15 bar.

8. A lamp according to claim 1, wherein Wt/Di>0.2, preferably Wt/Di>0.25, more preferably Wt/Di>0.3.

9. A lamp according to claim 1, wherein the discharge vessel is surrounded by a transparent substantially cylindrical gas filled outer bulb having its wall at a distance which is less than 1 mm, preferably less than 0.5 mm.

10. A lamp according to claim 1, wherein the discharge vessel is provided with coated areas for increasing the coldest spot temperature.

* * * * *